US005153368A

United States Patent [19]

Fogle, Jr.

[11] Patent Number: 5,153,368

[45] Date of Patent: Oct. 6, 1992

[54] FILTERED ELECTRICAL CONNECTION ASSEMBLY USING POTTED FERRITE ELEMENT

[75] Inventor: Homer W. Fogle, Jr., Wallingford, Pa.

[73] Assignee: ICI Americas, Inc., Wilmington, Del.

[21] Appl. No.: 706,211

[22] Filed: May 28, 1991

[51] Int. Cl.[5] ..... F42B 3/188

[52] U.S. Cl. ..... 102/202.2

[58] Field of Search ..... 102/202.2; 174/52.2, 174/52.3, 35 R; 264/272.11, 272.13

[56] References Cited

U.S. PATENT DOCUMENTS

| | | | |
|---|---|---|---|
| 2,377,804 | 6/1945 | Narvarte | 102/202.2 |
| 2,716,722 | 8/1955 | Rothstein | 264/272.17 |
| 2,960,641 | 11/1960 | Cohen et al. | 264/272.17 |
| 3,264,320 | 9/1966 | Reber | 264/272.19 |
| 3,264,989 | 8/1966 | Rucker | 102/202.2 |
| 3,572,247 | 3/1971 | Warshall | 102/202.2 |
| 3,670,091 | 6/1972 | Frantz et al. | 174/52.2 |
| 3,721,747 | 3/1973 | Renskers | 174/52.2 |
| 4,001,655 | 1/1977 | Voyles et al. | 174/52.2 |
| 4,042,955 | 8/1977 | Imai et al. | 174/52.2 |
| 4,092,487 | 5/1978 | Imai | 174/52.2 |
| 4,289,722 | 9/1981 | Tranbarger | 264/272.13 |
| 4,378,738 | 4/1983 | Proctor et al. | 102/202.2 |
| 4,422,381 | 12/1983 | Barrett | 102/202.2 |
| 4,517,895 | 5/1985 | Rucker | 102/202.2 |
| 4,542,260 | 9/1985 | Pearce | 264/272.17 |
| 4,696,776 | 9/1987 | Hooker et al. | 264/272.13 |
| 4,849,048 | 7/1989 | Inagaki et al. | 264/272.13 |

OTHER PUBLICATIONS

IEEE Transactions on Magnetics, vol. VI, Mar. 1970 Article by J. H. Magee and Robert D. Fisher "*Polymer Encapsulation of Linear Ferrite Cores*".

Insulation/Circuits, Jan. 1981, Article by Jan M. van der Poel "*Vacuum Impregnation of Wound Ferrite Components:Potential Problems and Pitfalls*".

CDI (Ceramic Devices, Inc.) pp. 3, 45, 46.

*Primary Examiner*—Charles T. Jordan

*Attorney, Agent, or Firm*—Howson & Howson

[57] ABSTRACT

A filtered electrical connection assembly in an electro-explosive device uses a lossy magnetostrictive ferrite element surrounding an electrical conductor. The ferrite element is immersed in a dielectric heat transfer liquid, and an epoxy-based potting compound, used to seal the opening through which electrical wires enter the device, is maintained separate from the ferrite element so that its shrinkage during curing does not compressively load the ferrite element and thereby impair its effectiveness as an RF attenuator. The liquid transfers heat away from the ferrite element, thereby preventing its effectiveness from being degraded by high temperatures, and preventing excessive heat from being conducted toward the pyrotechnic charge, and its initiating bridge, through the electrical conductor.

16 Claims, 1 Drawing Sheet

FILTERED ELECTRICAL CONNECTION ASSEMBLY USING POTTED FERRITE ELEMENT

BRIEF SUMMARY OF THE INVENTION

This invention relates to electrical filters, and more particularly to a filtered electrical connection using a potted ferrite element. The invention has utility in such applications as feed-through radio frequency interference (RFI) filters and combination filter-connector devices, and in preventing radio frequency interference from causing ignition of electroexplosive devices (EEDs), Such as the igniters as described in U.S. Pat. No. 4,422,381 that are used in automotive air bag inflation systems and in collision-actuated seat belt retractors, and in other devices such as detonators for explosive munitions, mineral mining charges and pyrotechnic devices.

Ferrite elements are widely used as lossy inductive components in miniature low-pass filters that attenuate incident RF signal power. For example, feed-through connectors used to conduct direct current through metal housings of electronic circuits typically utilize the combination of a ferrite bead surrounding the DC conductor, and a discoidal capacitor between the DC conductor and a casing, to provide an "L"-type, low-pass filter network.

The ferrite elements in existing ferrite RFI filters are typically encased in epoxy potting compounds containing polyamide curing agents. These potting compounds are applied in liquid form, and cure to a hard and durable solid. Unfortunately, the epoxy-based potting compounds shrink as they cure, and tend to exert compressive force on the encapsulated ferrite element. Furthermore, the cured potting compound is generally a poor thermal conductor and will thereby act as a thermal insulator inhibiting the transfer of heat from the ferrite element to the filter's case and thence to the environment. Finally, differences between the thermal coefficients of expansion of the ferrite material and the cured potting compound can result in adverse compressive loading upon the ferrite at low temperatures.

Most lossy ferrite materials, including the manganese and nickel-zinc spinel ferrites most commonly used in RFI filters, are magnetostrictive in that their intrinsic magnetic properties, specifically permeability and loss factor, exhibit changes when subjected to mechanical stress. This phenomenon is known as the "Villari effect" or "inverse magnetostriction". Furthermore, the magnetic permeability and loss factor will be strong non-linear functions of material temperature. Magnetic permeability and loss factor will undergo severe changes if the ferrite is brought to the Curie temperature, typically 150° C. for materials commonly used in RFI filters.

The electrical RF power attenuation of a filter network is achieved partially by the reflection of incident power at the input port and partially by absorption, i.e. thermal dissipation, of RF power within the filter network. The magnitudes of the reflected and absorbed RF power flows will depend in part upon the complex electrical impedance of the constituent ferrite component. This extrinsic or lumped impedance comprises an inductive reactance component and a dissipative resistance component. The constituent inductance is a function of the ferrite's magnetic permeability and its physical dimensions, while the dissipative resistance is a function of the ferrite's magnetic loss factor and its physical dimensions. It follows that the RF attenuation of a filter incorporating a ferrite element is a joint function of the mechanical stress state and temperature state of the ferrite element.

The RF power attenuation of a potted filter will often be less than an identically constructed but unpotted filter. A first reason for this is that the compressively loaded ferrite exhibits a lower inductive reactance resulting in a diminishment of the reflected RF power flow. A second reason is that the compressively loaded ferrite exhibits a lower dissipative resistance resulting in diminished RF power absorption in the ferrite medium and therefore diminished conversion to heat. A third reason that potting adversely affects RF power attenuation by ferrite elements is that the ferrite, unable to shed heat efficiently due to the insulating characteristics of the surrounding potting compound, experiences a rise in temperature that adversely affects its magnetic properties. The third effect becomes particularly significant if the ferrite element's temperature reaches the material's Curie temperature, whereupon the ferrite becomes completely ineffective as an attenuator circuit component.

The consequences of the above-stated thermomechanical interactions between the ferrite element and the contiguous potting compound are performance restrictions in the potted filter's rated RF attenuation, power handling capacity and service temperature range. In general, potted filter performance equivalent to that obtainable for identical unpotted filters can only be obtained by employing a dimensionally larger ferrite element having greater inductive reactance, dissipative resistance and surface-to-case thermal conductance to accommodate the diminishment of these properties brought on by the potting compound. This leads to filters having greater size than is desired in many applications.

In a hot bridgewire type EED, electrical failure of the RFI filter to attenuate spurious RF signals adequately can lead to direct ohmic heating of the bridgewire (the resistive wire which thermally ignites or detonates the pyrotechnic charge) by conducted RF currents. Untoward ignition can result from the heating of the bridgewire by RF current. Another cause of untoward ignition is thermal failure of the RFI filter. In the case of thermal failure, heat generated by RF signal absorption within the ferrite element is conducted principally to the pyrotechnic charge via the EED's metallic electrodes, instead of being shed to the environment via conduction through the surrounding insulating potting compound to the EED case. This can result in a cook off ignition or detonation of the pyrotechnic charge.

Heretofore, the above mentioned negative effects of hard-curing potting compounds have been partially avoided by two general techniques. A first approach has been to use potting compounds which cure to a softer or more compliant state. A second approach has been the use of conformal coatings for the ferrite element which reduce the potting-induced compressive loading forces on the encapsulated ferrite element.

The use of softer potting compounds, for example, polydimethylsiloxane based silicone rubbers or urethane resins, invariably results in filter assemblies lacking in mechanical strength and can also lead to diminished chemical resistance or restricted service temperature ratings for the potted device. Furthermore, such materials can exhibit poor thermal conductivity, a property essential for effective conductive heat transfer from the ferrite element to the filter casing. U.S. Pat. No. 4,696,776, dated Sep. 29, 1987, describes an encapsulation technique using polyurethane foams having relatively low strength and low heat transfer capabilities. Techniques for increasing the thermal conductivity of these materials, for example the inclusion of thermally conductive fillers such as zinc oxide, can further diminish the mechanical strength of the potted assembly.

The use of coatings for the ferrite element to achieve a compression force alleviating or adhesion-resisting intermediate layer between the surface of the ferrite and the surrounding hard potting compound are described in U.S. Pat. No. 4,001,655. These techniques are known to be beneficial in that the ferrite is relieved of a portion of the potting induced stress. For example, the vacuum deposition of a 0.001 inch thick layer of PARYLENE "C" (polymonochloroparaxylylene) manufactured by Union Carbide Corporation to the ferrite element has been reported to provide partial relief from the mechanical compressive stress-inducing effects of varnishes on the ferrite cores of transformers and inductors. See Jan M. van der Poel "Vacuum Impregnation of Wound Ferrite Components: Potential Problems and Pitfalls," *Insulation/Circuits* (Lake Publishing: Libertyville, Ill.), January 1981. However, even where PARYLENE coatings are used, some degradation in performance is still encountered. Furthermore, PARYLENE has a relatively low thermal conductivity, and therefore tends to prevent good transfer of heat from the ferrite element to the filter casing. Further information on PARYLENE coating of ferrite cores is given in James H. McGee and Robert D. Fisher, "Polymer Encapsulation of Linear Ferrite Cores," *IEEE Transactions on Magnetics,* VI, March 1970, pp. 34–37.

Selective metallic plating of ferrite elements can be used to enhance their thermal mating to the case in which they are contained. Alternatively, the thermal conductivity of the ferrite-to-case heat transfer path can be improved by maintaining close dimensional tolerances for the ferrite elements. In U.S. Pat. No. 4,422,381, for example, a tightly toleranced ferrite bead is provided with a conductive solder layer between its outside diameter and the inside diameter of the surrounding case. The approach of maintaining close tolerances and/or selective plating, however, are difficult and expensive to implement.

The principal object of this invention is to improve the miniaturization of lossy magnetostrictive ferrite-based RFI filters, by providing an improved potting technique.

Another object of this invention is to provide a miniaturized potted ferrite element which exhibits improved RF attenuation performance.

A further object of the invention is to provide an improved potted ferrite element the performance of which is not seriously degraded by heating resulting from the absorption of RF power.

Still a further object of the invention is to improve the safety and performance of electroexplosive devices by providing for improved immunity to RFI.

Still a further object of the invention is to provide an improved filter using a potted ferrite element, which efficiently dissipates heat generated in the ferrite element, but which is easy and inexpensive to manufacture.

To address the foregoing objects, the filtered electrical connection assembly in accordance with the present invention comprises a chamber having an opening at one end. The chamber is bounded by a wall composed, at least in part, of thermally conductive material, and at least one electrical conductor extends through the opening. A dielectric heat transfer liquid is located within the chamber, and a lossy magnetostrictive ferrite element, also located within the chamber, is immersed in the dielectric liquid and magnetically coupled to the electrical conductor. A potting compound, located within the chamber between the dielectric heat transfer liquid and the opening, fills the space between the electrical conductor and the wall of the chamber to provide a durable, high strength seal between the dielectric heat transfer liquid and the exterior of the chamber. Preferably, the ferrite element is located entirely on one side of the interface of the dielectric heat transfer liquid and the potting compound.

The dielectric heat transfer liquid preferably has a specific gravity higher than that of the potting compound, at least when the potting compound is in its uncured state, so that the uncured potting compound floats on the dielectric heat transfer liquid and remains out of contact with the ferrite element during curing. Preferably, the dielectric heat transfer liquid is substantially immiscible with the uncured potting compound.

The dielectric heat transfer liquid should be chemically non-reactive with the potting compound, both in the cured and uncured states. Of course, the dielectric heat transfer liquid should also be non-reactive with the ferrite bead and with any coating thereon, and also non-reactive with the thermally conductive wall material of the chamber.

The dielectric heat transfer liquid is preferably a perfluorocarbon heat transfer liquid.

Further objects, advantages and details of the invention will be apparent from the following detailed description, when read in conjunction with the drawings.

DETAILED DESCRIPTION

Figure 1:
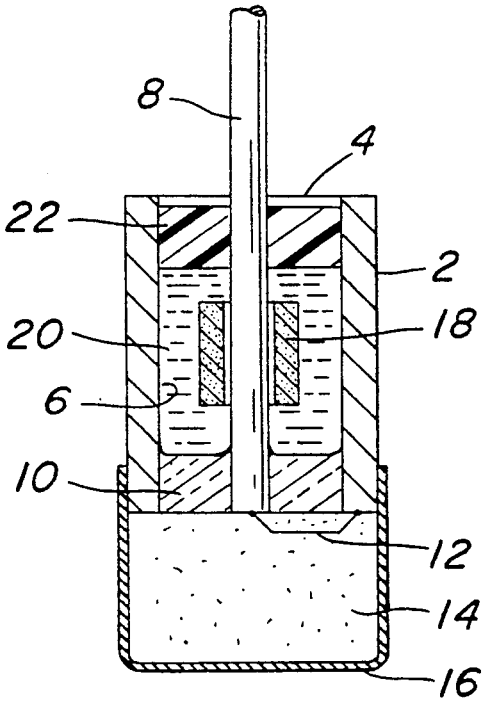
FIG. 1 is an axial section of an electroexplosive device (EED) in accordance with the invention having coaxial electrodes.

The EED shown in FIG. 1 is an electrically operated igniter of the kind used to trigger the deflagration charge which inflates an automotive airbag upon impact. It comprises a thermally and electrically conductive metal sleeve 2 having a end opening 4, and a cylindrical inner wall 6. A central electrode 8 is disposed within sleeve 2 in coaxial relationship with cylindrical wall 6, the latter serving as an outer electrode. A glass seal 10 maintains the lower end of the central electrode spaced from, and electrically insulated from, sleeve 2, and a resistive bridge wire 12 is connected between conductor 8 and sleeve 2 and in contact with a pyrotechnic charge 14 within a cup 16 attached to the lower end of sleeve 2.

Bridge wire 12 is heated by electric current supplied through electrode 8 and sleeve 2 to initiate pyrotechnic charge 14.

A hollow, cylindrical, lossy magnetostrictive ferrite bead 18 is positioned within the interior of sleeve 2, with electrode 8 extending through a central passage in the bead. The ferrite bead is completely immersed in a dielectric heat transfer liquid 20 and is contained within sleeve 2. The chamber containing liquid 20 is sealed at one end by glass seal 10 and end opening 4 is sealed by a potting compound 22.

Figure 2:
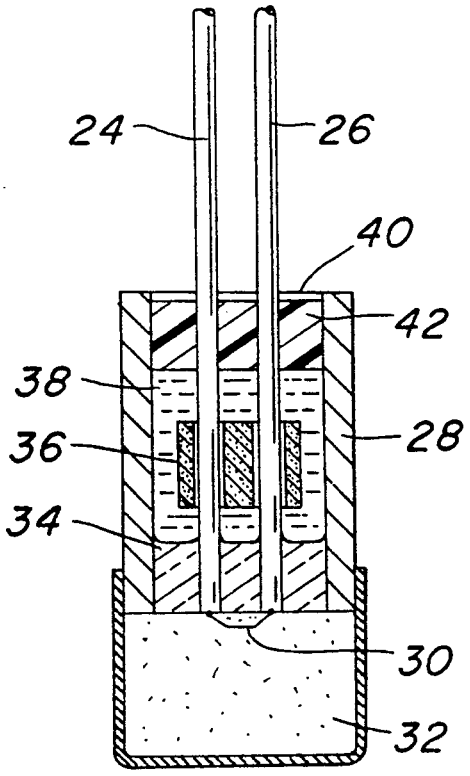
FIG. 2 is an axial section of an electroexplosive device in accordance with the invention, having twin parallel electrodes.

In FIG. 2, twin parallel electrodes 24 and 26 extend through a thermally conductive sleeve 28, and are connected by a bridge wire 30 in contact with a pyrotechnic charge 32. The lower end of sleeve 28 is provided with a glass seal 34, which maintains the electrodes insulated from each other and from the sleeve. A lossy magnetostrictive ferrite element 36 is located within sleeve 28, and electrodes 24 and 26 extend through parallel holes in the ferrite element. Here again, the ferrite element is immersed in a dielectric heat transfer liquid 38 contained within sleeve 28, and the upper opening 40 of the sleeve is sealed by a potting compound 42.

The potting structure shown in FIGS. 1 and 2 accomplishes the objective of miniaturization in two ways. First, because the epoxy seal is separated from the ferrite element, shrinkage of the epoxy potting compound as it cures does not compressively load the ferrite element and thereby degrade its performance as an RF attenuator. Second, the dielectric heat transfer liquid with which the ferrite element is in contact readily conveys heat away from the ferrite element to the thermally conductive sleeve. Therefore, the ferrite element can be very small in size, and yet provide excellent RF attenuation performance.

The dielectric heat transfer liquid in which the ferrite element is immersed transfers heat away from the ferrite element by a combination of direct conduction and free convection.

Because the dielectric heat transfer liquid operates in part by convection, it should have a low viscosity so that it flows readily, and a high coefficient of thermal expansion so that the buoyant forces resulting from changes in density with temperature cause natural convective circulation of the liquid. Because the liquid also operates in part by conduction, which will be especially significant in cases where flow is restricted, high thermal conductivity is desirable. The liquid should have a high density so that the uncured potting compound will float on it during assembly.

The viscosity, density, coefficient of thermal expansion and thermal conductivity should be in the following ranges at an ambient temperature (25° C.). The viscosity is preferably in the range of 1.5 to 3.5 lb./ft.-hr. The density should be greater than that of the uncured potting compound, and is preferably at least 105 $lb/ft^3$ and can range up to 125 $lb/ft^3$ or more in practice. The coefficient of thermal expansion is preferably at least 0.0007 ml/(ml)(°C.). The thermal conductivity is preferably at least 0.03 $BTU/hr\text{-}ft^2\text{-}°F./ft$.

Various dielectric heat transfer liquids capable of operating by convection can be used. The preferred convection-type heat transfer liquids are perfluorocarbons. Acceptable perfluorocarbons include perfluoroalkanes having the chemical formula $C_nF_{2n+2}$, where n is in the range of 5–18. Examples of such perfluoroalkanes include the following heat transfer fluids available from 3M Company of St. Paul, Minn.: FLUORINERT FC-72, FLUORINERT FC-75 and FLUORINERT FC-77. Other more viscous perfluorocarbons include perfluorotrialkylamines, such as FLUORINERT FC-40 and FLUORINERT FC-43, both also available from 3M Company can be used in high temperature applications, such as for explosive detonators used to perforate well casings for the extraction of crude oil in subsurface deposits. The above-mentioned heat transfer liquids are identified by Chemical Abstract number CAS #86508-42-1, and comply with Military Specification MIL-H-81829 for heat transfer fluids.

Of course, the pour point of the dielectric heat transfer liquid should be above the minimum service temperature of the RFI filter and the boiling point of the dielectric heat transfer liquid should be below the maximum service temperature of the RFI filter.

It is important that there be no significant mixing of the dielectric heat transfer liquid and the uncured potting compound in the assembly process. The perfluorocarbons mentioned above are substantially immiscible with most common uncured epoxy-based potting compounds.

In the assembly of the devices of FIGS. 1 and 2, the heat transfer liquid is degasified, and introduced into the sleeve through its end opening in sufficient quantity to immerse the ferrite element completely. The liquid is introduced while the sleeve is positioned with its end opening (opening 4 or 40) facing upward, preferably vertically upward. The sleeve remains in this position while the potting compound is introduced and cured. The potting compound floats on top of the dielectric heat transfer liquid until it cures.

The potting compound can be any of a variety of conventional potting compounds, for example an epoxy-polyamide potting compound comprising Dow Chemical Company's DER 331 epoxy resin and Henkel Corporation's VERSAMID 125 polyamide resin curing agent.

The potting compound, being separate from the lossy magnetostrictive ferrite element, imparts no mechanical stress to said element due to shrinkage of the cured compound.

The dielectric heat transfer liquid should be chemically non-reactive with the potting compound, both in the cured and uncured states, and should also be non-reactive with the ferrite bead and with any coating on the ferrite bead, such as polymonochloroparaxylylene. Likewise, the dielectric heat transfer liquid should not react chemically with any of the other elements which it contacts, i.e. the electrodes 8, 24 and 26, the interior walls of sleeves 2 and 28, and seals 10 and 34.

A ferrite element coated with an insulating compound such as polymonochloroparaxylylene would ordinarily have a tendency to overheat, with a resultant degradation of its RF attenuation properties. However, the dielectric heat transfer liquid in which the ferrite element is immersed is able to conduct heat away from the ferrite element at a rate sufficient to prevent overheating, despite the presence of the coating.

In operation of the EEDs described above, the ferrite elements effectively attenuate RF signals applied to the electrodes so that RF currents passing through the bridgewire are of insufficient magnitude to initiate ignition or detonation of the pyrotechnic charge. RF signal power absorbed by the ferrite elements is converted to heat that is conducted and convected by the dielectric heat transfer liquid to the EED casing and thence to the environment. The removal of heat from the ferrite elements prevents said elements from approaching their Curie temperatures, and consequently losing their effectiveness as RF attenuators. The transfer of heat from the ferrite to the EED casing in preference to the pyrotechnic charge chamber precludes the untoward cook off ignition of the pyrotechnic charge.

The invention makes it possible to construct a filter providing a specified minimum RF attenuation and power handling capacity over a given service temperature range with the smallest practicable lossy magnetostrictive ferrite element since the electrical performance of the filter circuit and the thermal performance of the heat transfer circuit are not degraded by the effects of a cured potting compound action on the ferrite element of the filter.

The invention eliminates the need for selective metallic plating of ferrite elements to enhance their thermal mating to the case in which they are contained. Furthermore, dimensional tolerances for the ferrite elements can be relaxed without significantly increasing the thermal resistance of the ferrite-to-case heat transfer path.

Significant where the invention is applied to EEDs, is the fact that the RF attenuation properties of the filter are improved at high FR power levels where energy absorption and dissipation are most critical.

Various modifications can be made to the assembly described herein. For example, multiple ferrite beads can be immersed in a dielectric heat transfer liquid in a single device. In still another modification, the ferrite element can be the core of a solenoid winding or of a toroidal winding. Numerous other modifications can be made to the invention described herein without departing from the scope of the invention as defined in the following claims.

I claim:

1. A filtered electrical connection assembly comprising:

means providing a chamber having an opening at one end and bounded by a wall composed, at least in part, of thermally conductive material;

means providing at least one electrical conductor extending through said opening;

a dielectric heat transfer liquid located within said chamber;

a lossy magnetostrictive ferrite element located within said chamber, immersed in said dielectric heat transfer liquid and magnetically coupled to said electrical conductor-providing means; and a potting compound located within said chamber between said dielectric heat transfer liquid and said opening, said potting compound filling the space between said electrical conductor means and said wall of the chamber to provide a seal between the dielectric heat transfer liquid and the exterior of the chamber.

2. An assembly according to claim 1 in which said dielectric heat transfer liquid has a specific gravity higher than that of said potting compound when the potting compound is in the uncured state, and is chemically substantially non-reactive with said potting compound.

3. An assembly according to claim 1 in which said dielectric heat transfer liquid is substantially immiscible with the potting compound while the potting compound is in the uncured state.

4. An assembly according to claim 1 in which said dielectric heat transfer liquid is a perfluorocarbon heat transfer liquid.

5. An assembly according to claim 1 in which said dielectric heat transfer liquid is a perfluorocarbon heat transfer liquid substantially free of dissolved gas.

6. An assembly according to claim 1 in which said potting compound has a tendency to shrink upon curing.

7. An assembly according to claim 1 in which said potting compound comprises an epoxy resin.

8. An assembly according to claim 1 in which said potting compound comprises an epoxy resin and a polyamide curing agent.

9. An assembly according to claim 1 in which said ferrite element has a coating of polymonochloroparaxylylene.

10. An assembly according to claim 1 in which said means providing a chamber is a casing of an electroexplosive device.

11. An assembly according to claim 1 having an interface between said dielectric heat transfer liquid and said potting compound, and in which said ferrite element is located entirely on the liquid dielectric side of said interface.

12. A filtered electrical connection assembly comprising:

a chamber defined by a wall and having an opening at one end;

a dielectric heat transfer liquid located within said chamber;

a lossy magnetostrictive ferrite element located within said chamber, and immersed in said dielectric heat transfer liquid, said ferrite element having a hole extending through it;

at least one electrical conductor extending through said opening into said chamber and through the hole in said ferrite element;

a potting compound located within the chamber between the dielectric heat transfer liquid and the opening, said potting compound filling the space between said electrical conductor means and said wall to provide a seal between the dielectric heat transfer liquid and the exterior of the chamber.

13. The method of making a filtered electrical connection assembly comprising the steps of:

providing a chamber bounded by a wall composed, at least in part, of a thermally conductive material, and having an open end and a closed opposite end;

positioning electrical conductor means so that it extends through said open end into said chamber;

positioning a lossy magnetostrictive ferrite element within said chamber in magnetically coupled relationship to said electrical conductor means;

positioning said chamber with its open end substantially above said closed end;

introducing into said chamber a sufficient quantity of dielectric heat transfer liquid to immerse said ferrite element;

thereafter introducing into said chamber an uncured potting compound in an amount sufficient to cover the surface of said dielectric heat transfer liquid and to provide a seal between the dielectric heat transfer liquid and the exterior of the chamber; and curing said potting compound, thereby sealing said dielectric heat transfer liquid and the immersed ferrite element within said chamber.

14. The method according to claim 13 in which the ferrite element is completely immersed in said dielectric heat transfer liquid whereby the potting compound is maintained separated from said ferrite element.

15. The method according to claim 13 including the step of degasifying said quantity of dielectric heat transfer liquid before introducing said quantity of liquid into said chamber.

16. The method according to claim 13 in which the potting compound shrinks during said curing step.

* * * * *